US005651697A

United States Patent [19]

Cinquegrani et al.

[11] Patent Number: 5,651,697

[45] Date of Patent: Jul. 29, 1997

[54] PANEL MOUNTED ELECTRICAL CONNECTOR

[75] Inventors: James Cinquegrani, Carol Stream; Kirk B. Peloza, Naperville, both of Ill.

[73] Assignee: Molex Incorporated, Lisle, Ill.

[21] Appl. No.: 568,876

[22] Filed: Dec. 11, 1995

[51] Int. Cl.[6] ..... H01R 13/74

[52] U.S. Cl. ..... 439/557; 439/374

[58] Field of Search ..... 439/557, 558, 439/680, 681, 374

[56] References Cited

U.S. PATENT DOCUMENTS

| | | | |
|---|---|---|---|
| D. 316,703 | 5/1991 | Eto et al. | D13/147 |
| 3,523,269 | 8/1970 | Witek, Jr. et al. . | |
| 3,790,923 | 2/1974 | Mathe | 339/128 |
| 4,541,036 | 9/1985 | Landries et al. | 361/426 |
| 4,986,766 | 1/1991 | Leonard et al. | 439/352 |
| 5,131,867 | 7/1992 | Peloza et al. | 439/557 |
| 5,249,982 | 10/1993 | Funck et al. | 439/556 |
| 5,277,623 | 1/1994 | Colleran et al. | 439/552 |
| 5,547,394 | 8/1996 | Comstock | 439/557 |

*Primary Examiner*—Gary F. Paumen
*Attorney, Agent, or Firm*—Stephen Z. Weiss

[57] ABSTRACT

An electrical connector is adapted for mounting in an aperture in a panel. A housing has sidewalls bounding an insertion end of the housing insertable into the aperture. A bridge is secured at opposite ends to one of the sidewalls with an intermediate portion and a panel latch being freely flexible relative to the housing. At least one of the opposite ends of the bridge includes a pair of redundant supporting arms. A yieldable anti-vibration arm projects from another of the sidewalls and is mounted to the housing by a pair of redundant support arms. A polarizing rib projects from the housing, and a panel abutment stop is formed integral with the polarizing rib on a radius.

12 Claims, 3 Drawing Sheets

PANEL MOUNTED ELECTRICAL CONNECTOR

FIELD OF THE INVENTION

This invention generally relates to the art of electrical connectors and, particularly, to an electrical connector mountable in an aperture in a panel or the like.

BACKGROUND OF THE INVENTION

Panel mountable electrical connectors are well known for connecting a wiring harness, or the like, to another electrical device, such as a second electrical connector, in a panel such as a housing or chassis. The second connector may be terminated to another wiring harness, a cable, a circuit board or a second panel. Panel mounted electrical connectors usually include a housing having terminals mounted therein, the housing typically being of nonconductive material which may be partly or entirely molded from plastic. The housing includes a mating end with structure that permits mating and unmating with the second electrical connector. The mating end usually is the insertion end of the connector.

Heretofore, panel mountable electrical connectors often have been mounted directly to the panel. The mating end of the connector is inserted through an aperture in the panel. Means are provided on the connector housing for achieving secure mounting to the panel. For example, the connector housing may include a stop flange which exceeds the cross-sectional dimensions of the mounting aperture in the panel. A portion of the connector housing will extend through the mounting aperture and will be engageable with separate retaining means, such as a nut or clamp engageable against the opposite side of the panel. A portion of the panel therefore will be locked between the stop flange, the connector housing, and the separate retaining means. In other such panel mountable connectors, integral latch arms engage the panel, thereby avoiding the need to employ separate panel engaging means with the electrical connector housing. A portion of the panel will be locked between the integral latch arms and the stop flange.

In addition, many of the panel mountable electrical connectors described above include the provision of anti-vibration means to protect the connector components or the mating connection of the connector with the second electrical connector from vibrations due to the mounting of the connector. The applications can range from automobiles to refrigerators and countless other environments. For instance, the connector housing often is provided with an anti-vibration arm which engages one side of the panel and which is yieldable or sufficiently flexible to bias the connector against the panel and to take up any slack therebetween which might otherwise result in rattling of the connector in response to vibrations. Still further, panel mountable electrical connectors often include polarizing ribs which also project outwardly of the connector housing to prevent the connector from being mated with the second connector in an incorrect orientation.

Most of the connector housings of such connectors are unitarily molded of dielectric material such as plastic or the like. The outwardly projecting stop flanges, latch arms, anti-vibration arms and polarizing means all are molded integrally with the housing. It can be understood that such unitarily molded structures which perform such a multitude of functions can become quite complicated, difficult to mold with integrity, and the outwardly projecting latches, stops, arms etc. are prone to tangling and breakage, particularly with the strong handling and high insertion forces often carried out by operators in using panel mountable electrical connectors. The present invention is directed to solving this myriad of problems by providing a panel mountable connector with various improved features to facilitate insertion of the connector housing through the panel aperture and to prevent or minimize tangling and breakage problems.

SUMMARY OF THE INVENTION

An object, therefore, of the invention is to provide a new and improved panel mountable electrical connector of the character described.

In the exemplary embodiment of the invention, the electrical connector is adapted for mounting in an aperture in a panel. A connector housing has sidewall means bounding an insertion end of the housing insertable into the aperture. A latch projects from the sidewall means of the housing for engaging a side of the panel. Bridge means are secured at opposite ends to the sidewall means of the housing, with an intermediate portion of the bridge means being freely flexible relative to the housing. The latch is disposed on the freely flexible intermediate portion of the bridge means. At least one of the opposite ends of the bridge means includes a pair of spaced support arms to provide a redundant supporting means for the latch to allow operability of the latch notwithstanding breakage of one of the support arms.

A yieldable anti-vibration arm projects from the connector housing for engaging the opposite side of the panel. Like the bridge means for the latch, the anti-vibration arm is mounted to the housing by a pair of support arms to provide a redundant supporting means for the anti-vibration arm.

A panel abutment stop is formed integral with the housing and projects transversely outwardly of the insertion end for abutting the side of the panel to define the limit position for insertion of the housing. The abutment stop is joined to the housing on a radius facing the side of the panel. The radius lowers the stress at the juncture between the abutment stop and the housing to minimize breakage thereat. As disclosed herein, a polarizing rib projects from the housing, and the panel abutment stop is formed integral with the polarizing rib on said radius.

Still further, in the preferred embodiment of the invention, at least the insertion end of the housing is generally rectangularly shaped in cross-section and includes outwardly protruding corner guide ribs to guide the insertion end into the aperture in the panel. The polarizing rib and the radius of the abutment stop, as well as the bridge means for the latch, all are substantially recessed within a peripheral profile defined by the corner guide ribs. Lastly, an end of the bridge means as well as an end of the polarizing rib are spaced inwardly of an end face at the insertion end of the housing. This ensures that the corner guide ribs are the only structure that guides the connector housing into the panel aperture, and the bridge means and the polarizing rib do not interfere with smooth, guided insertion of the connector through the panel.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
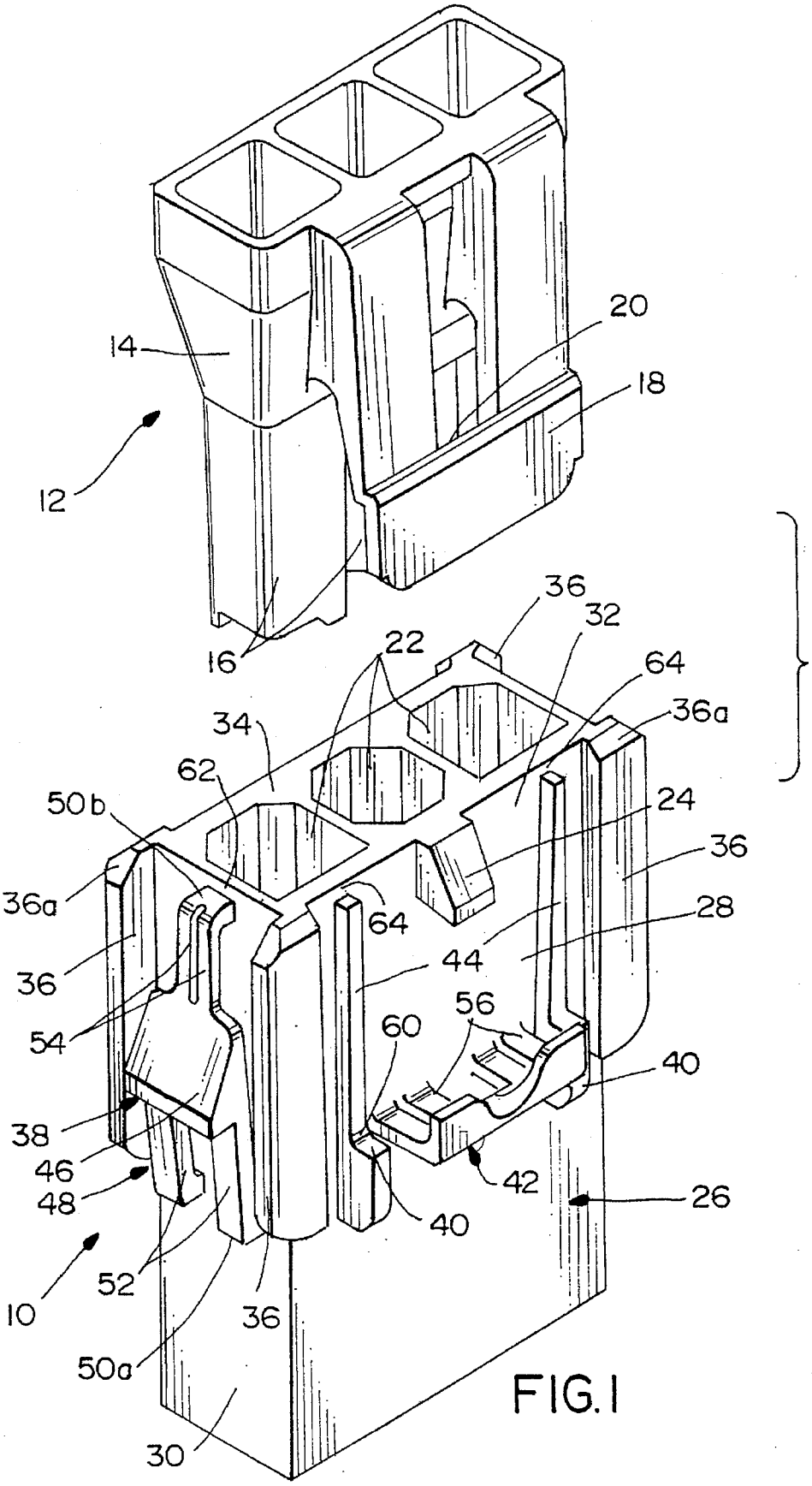
FIG. 1 is a perspective view of a panel mountable electrical connector embodying the concepts of the invention, along with a complementary second connector that is mateable with the first connector on the opposite side of a panel.

Referring to the drawings in greater detail, and first to FIG. 1, the concepts of the invention are embodied in an electrical connector, generally designated 10, adapted for mounting in an aperture in a panel. The connector is insertable through the aperture from an insertion side of the panel for mating with a complementary second connector, generally designated 12, on an opposite side of the panel. Second connector 12 includes a unitarily molded dielectric housing 14, such as of plastic material. The housing defines a plurality of silos 16 projecting from a mating end of the connector. A cantilevered latch arm 18 projects from one side of housing 14 and includes an interior latch shoulder 20. Second connector 12 is mateable with panel mountable connector 10 by inserting silos 16 into receptacles 22 of the panel mountable connector after the latter is mounted in the aperture of the panel. A chamfered connector latch 24 on a major side of connector 10 snaps into latching engagement with shoulder 20 on the underside of cantilevered latch arm 18 of complementary second connector 12.

Panel mountable electrical connector 10 includes a housing, generally designated 26, which is unitarily molded of dielectric material, such as plastic or the like. The housing has opposite side walls 28 defining the long or major sides of the connector and sidewalls 30 defining the minor or short sides of the connector. The housing sidewalls bound an insertion end 32 of the connector in which receptacles 22 are formed. The insertion end, in turn, defines an end face 34 of the connector housing. Four outwardly protruding guide ribs 36 are formed at the four corners of the insertion end of the connector housing. The guide ribs include chamfered corners **36*a*** which facilitate guiding the connector housing smoothly into and through the aperture in the panel.

Both connectors 10 and 12 mount a plurality of interengageable mating terminals as is well known in the art.

In addition to the corner guide ribs 36 which project outwardly from connector housing 26, other functional means project outwardly of the housing, including a latch means, generally designated 38, for passing through the panel and engaging an opposite side thereof; panel abutment stops 40 for abutting the insertion side of the panel and defining the limit position of insertion of the connector; yieldable anti-vibration arms, generally designated 42, for engaging the insertion side of the panel and preventing vibration of the connector relative to the panel; and polarizing ribs 44 in line with the outermost receptacles 22 to prevent second connector 12 from being mated with connector 10 in a crosswise orientation.

Figure 6:
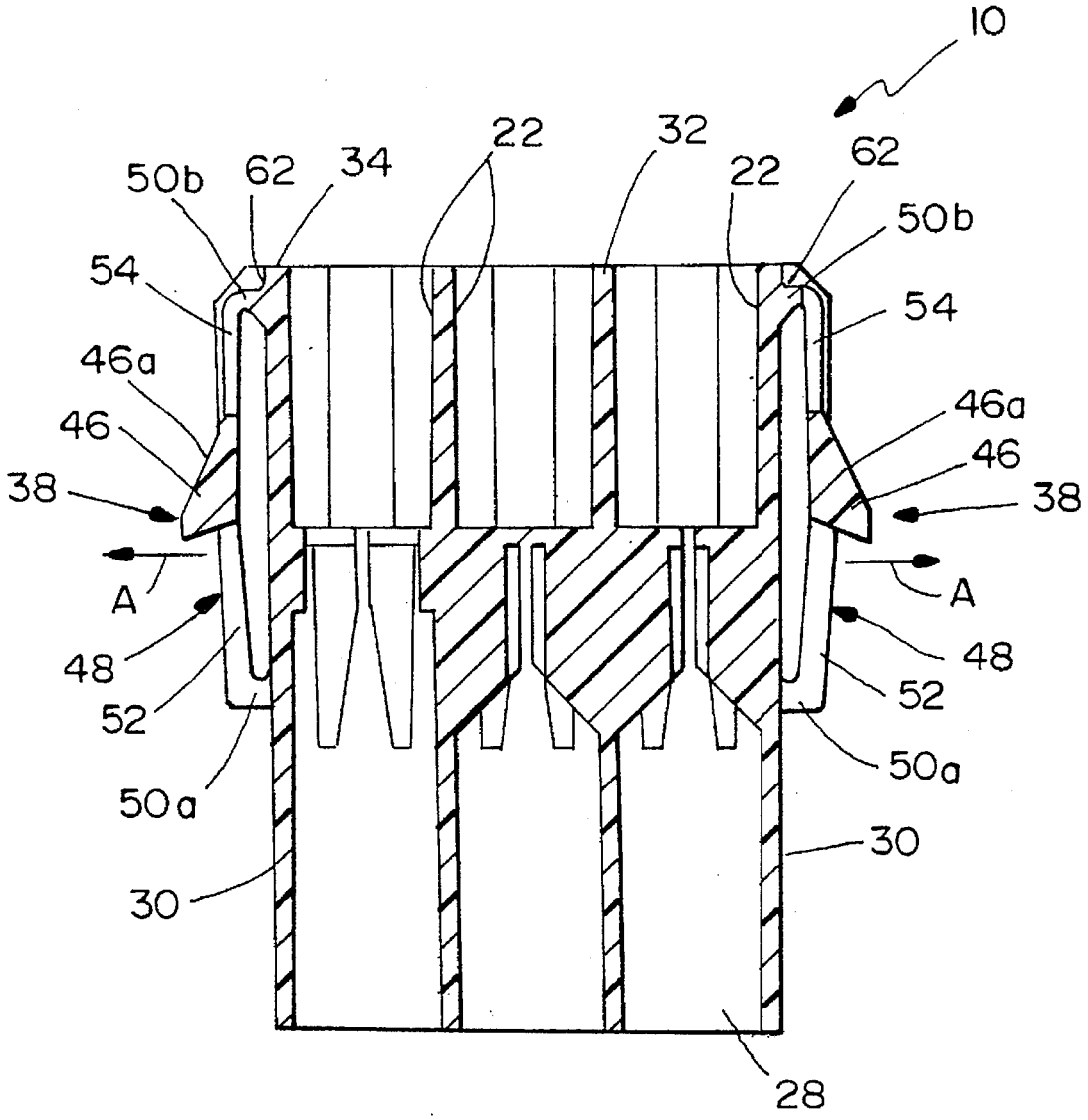
FIG. 6 is a vertical section taken generally along line 6—6 of FIG. 4.

More particularly, as best seen in FIG. 6 in conjunction with FIG. 1, latch means 38 includes a latch 46 projecting outwardly from a bridge, generally designated 48, which is secured at opposite ends **50*a* and 50*b* to each minor sidewall 30 of the connector housing. Ends 50 are molded integrally with the connector housing and the intermediate portion of bridge 48 between the secured opposite ends is freely flexible relative to the housing so that latch 46 is freely yieldable in the direction of double-headed arrows "A" (FIG. 6). As connector 10 is inserted into and through the aperture in the housing, leading chamfered or camming surfaces 46*a* of latches 46** engage the sides of the aperture and bias the latches inwardly toward the connector housing. Once the latches clear the opposite side of the panel, the latches will snap back outwardly under their inherent resiliency to engage the opposite side of the panel.

Figure 2:
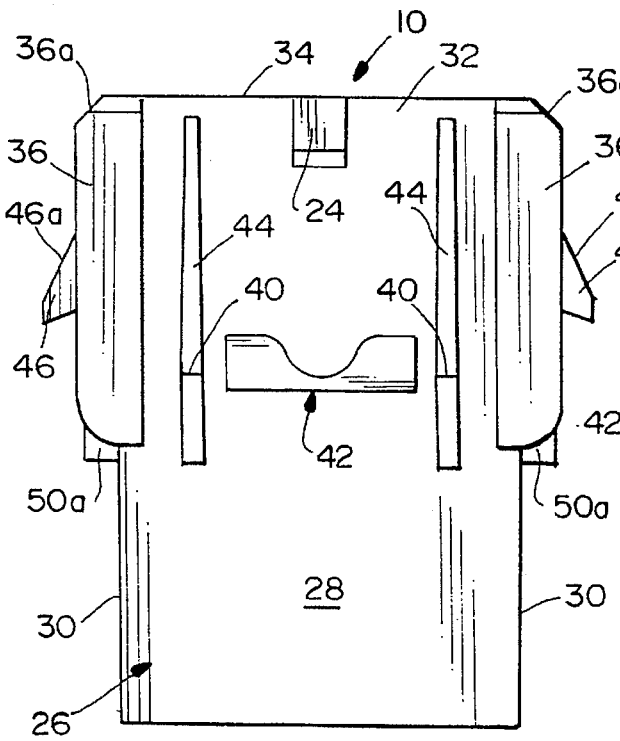
FIG. 2 is an elevational view of the major side of the connector.
Figure 3:
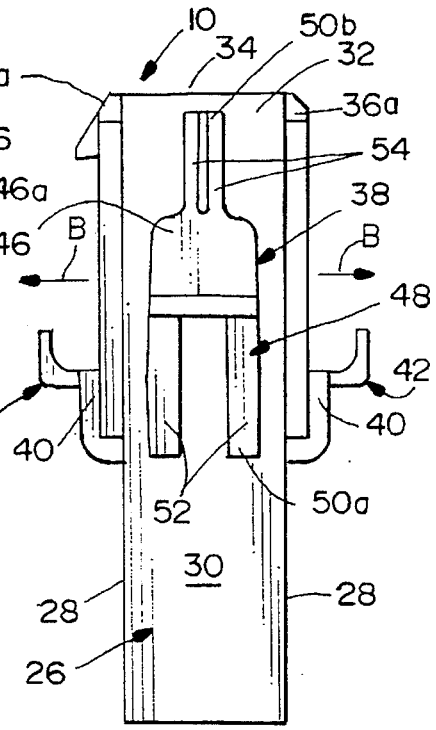
FIG. 3 is an elevational view of the minor side of the connector.

As best in FIG. 3, both ends **50*a* and 50*b* of bridge 48 which secures latch 46 to the housing have redundant supporting means to allow operability of latch 46 notwithstanding breakage of only one of the redundant supporting means. In other words, end 50*a* includes redundant support arms 52 and end 50*b* includes redundant support arms 54. If either of the support arms 52 at end 50*a* of bridge 48 becomes broken, the other support arm 52 is adequate to still allow latch 46 to function. Similarly, if either support arm 54 at end 50*b* becomes broken, the other support arm 54 allows latch 46 to remain functional. Thus, the combination of bridge 48 and the redundant support arms 52 and 54 at opposite ends of the bridge substantially insure against total breakage of latch means 38. The redundant design further results in a lower stress in response to displacements in the lateral "B" (FIG. 3) directions applied to latch 46, than would be the case had the support arms 52 been made into a single wide member. This is in contrast to the free ends of cantilevered latch arms of the prior art. Still further, as seen best in FIG. 2, bridge 48 is substantially recessed within the peripheral profile defined by corner guide ribs 36** so that even the bridge is not readily exposed to becoming entangled with extraneous objects.

Figure 4:
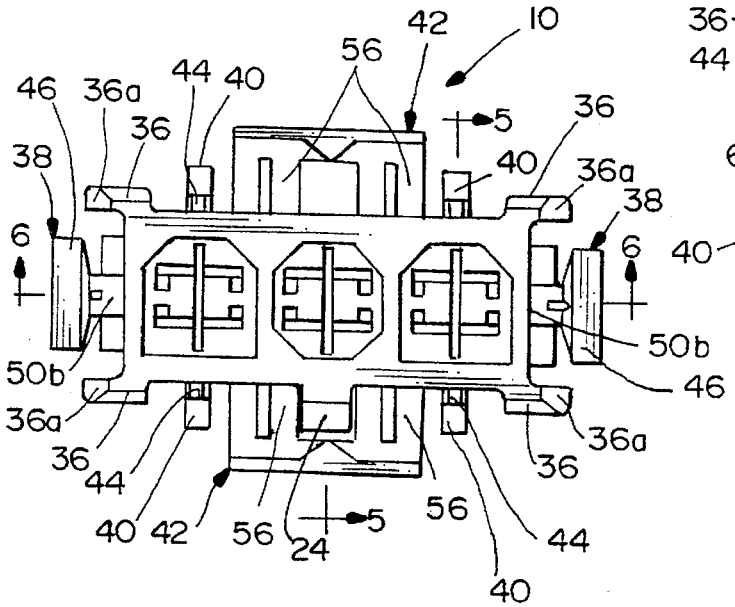
FIG. 4 is an end elevational view of the mating/insertion end of the connector.
Figure 5:
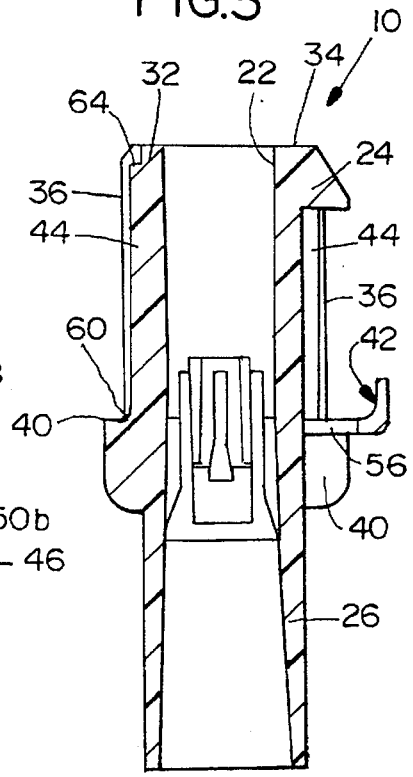
FIG. 5 is a vertical section taken generally along line 5—5 of FIG. 4.

Anti-vibration arm 42 is L-shaped as seen best in FIGS. 1 and 5 and is located for engaging the insertion side of the panel as latch 46 engages the opposite side of the panel. Like bridge 48, anti-vibration arm 42 is secured to the connector housing by a redundant support means in the form of a pair of support arms 56 at opposite ends of the elongated anti-vibration arm. Therefore, if one of the support arms 56 should become broken, the anti-vibration means still is functional to at least some extent. One anti-vibration arm 42 is located centrally of each opposite major sidewall 28 of the connector housing, as best seen in FIGS. 1, 2 and 4.

As best seen in FIGS. 1, 2, 4 and 5, panel abutment stops 40 are provided spaced from each opposite end of elongated anti-vibration arm 42. The panel abutment stops also are formed integral with and project outwardly from polarizing ribs 44. The panel abutment stops engage the insertion side of the panel, as latches 46 engage the opposite side of the panel. The abutment stops define the limit position of insertion of the connector into the panel. The abutment stops are molded integrally with polarizing ribs 44 on radii of 0.015 inches as indicated at 60 in FIG. 5. These radii lower the stresses at the corners where the abutment stops join the polarizing ribs to substantially lower if not eliminate breakage of the stops away from the housing at these points. As seen in FIG. 3, these radii, as well as polarizing ribs 44, are recessed or hidden within the peripheral profile defined by corner ribs 36. Therefore, the edges of the aperture in the panel cannot engage and destroy the radii 60, and the polarizing ribs do not interfere with smooth insertion of the connector housing into the panel which is the guiding function afforded by the corner guide ribs 36.

As stated above, polarizing ribs 44 are provided to prevent complementary second connector 12 from being partially mated with panel mountable connector 10. In other words, if second connector 12 is rotated 90° from its position shown in FIG. 1, theoretically a single one of the silos 60 could be inserted into a single one of receptacles 22. However, polarizing ribs 44 for the outermost receptacles and latch 24 for the center receptacle provide outwardly projecting portions of the housing which will abut against the end of an adjoining silo should an attempt be made to insert one of the silos into one of the receptacles 22.

Lastly, as seen at 62 in FIG. 6, bridges 48 are recessed or spaced inwardly of mating face 34 at the insertion end of the connector housing. In addition, as seen at 64 in FIG. 5, polarizing ribs 44 are spaced inwardly of mating face 34 at the insertion end of the housing. This ensures that the four corner guide ribs 36, with their chamfered corners **36*a*, are the primary projections from the connector housing which guide the connector into and through the panel aperture. With the four polarizing ribs and the two bridges being recessed or spaced from the insertion end of the housing, these six outwardly projecting components will not interfere with smooth insertion of the connector into the panel aperture. Connector latch 24** normally will not provide interference because the aperture is notched-out to allow clear passage of the connector latch through the aperture.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector for mounting in an aperture in a panel, comprising:

a housing having sidewall means bounding an insertion end of the housing insertable into said aperture;

a latch projecting from the sidewall means of the housing for engaging a side of the panel;

bridge means secured at opposite ends to the sidewall means of the housing, with an intermediate portion of the bridge means being freely flexible relative to the housing, and with said latch being disposed on the freely flexible intermediate portion of the bridge means;

at least one of the opposite ends of the bridge means comprising a pair of spaced support arms to provide a redundant supporting means for the latch to allow operability of the latch notwithstanding breakage of only one of the support arms; and a yieldable anti-vibration arm projecting from the housing for engaging an opposite side of the panel, the anti-vibration arm being mounted to the housing by a pair of support arms to provide a redundant supporting means for the anti-vibration arm.

2. The electrical connector of claim 1 wherein said housing, bridge means and latch are unitarily molded of dielectric material such as plastic.

3. The electrical connector of claim 1 wherein said insertion end of the housing has an end face, and said bridge means is spaced inwardly of the end face.

4. The electrical connector of claim 1 wherein said insertion end of the housing is generally rectangularly shaped in cross-section and includes outwardly protruding corner guide ribs to guide the insertion end into the aperture, and said bridge means is recessed substantially within a peripheral profile defined by the corner guide ribs.

5. An electrical connector for mounting in an aperture in a panel, comprising:

a housing having an insertion end insertable into said aperture;

a generally rigid panel abutment stop formed integral with the housing and projecting transversely outwardly of said insertion end for abutting the side of the panel to define the limit position of insertion of the housing, the abutment stop having a panel contact portion being joined to the housing on a radius facing said side of the panel; and the insertion end of the housing being generally rectangularly shaped in cross section and including outwardly protruding corner guide ribs to guide the insertion end into the aperture, the abutment stop radius recessed within a peripheral profile defined by the corner guide ribs and the abutment stop contact portion extending beyond the peripheral profile.

6. The electrical connector of claim 5, including a polarizing rib projecting from the housing, said panel abutment stop being formed integral with the polarizing rib on said radius.

7. The electrical connector of claim 6 wherein an end of said polarizing rib is spaced from a mating face at the insertion end of the housing.

8. The electrical connector of claim 6 wherein said polarizing rib is recessed within a peripheral profile defined by the corner guide ribs.

9. An electrical connector for mounting in an aperture in a panel, comprising:

a housing having sidewall means bounding an insertion end of the housing insertable into said aperture;

a latch projecting from the sidewall means of the housing for engaging a side of the panel;

bridge means secured at opposite ends to the sidewall means of the housing, with an intermediate portion of the bridge means being freely flexible relative to the housing, and with said latch being disposed on the freely flexible intermediate portion of the bridge means;

at least one of the opposite ends of the bridge means comprising a pair of spaced support arms to provide a redundant supporting means for the latch to allow operability of the latch notwithstanding breakage of only one of the support arms;

a polarizing rib projecting from the housing;

a panel abutment stop formed integral with the polarizing rib and projecting transversely outwardly of said insertion end for abutting the side of the panel to define the limit position of insertion of the housing; and a yieldable anti-vibration arm projecting from the housing for engaging an opposite side of the panel, the anti-vibration arm being mounted to the housing by a pair of support arms to provide a redundant supporting means for the anti-vibration arm.

10. The electrical connector of claim 9 wherein said panel abutment stop is formed integral with the polarizing rib on a radius facing said side of the panel.

11. The electrical connector of claim 9 wherein said insertion end of the housing has an end face, and an end of said polarizing rib and said bridge means are spaced inwardly of the end face.

12. The electrical connector of claim 9 wherein said insertion end of the housing is generally rectangularly shaped in cross-section and includes outwardly protruding corner ribs and said bridge means and said polarizing rib are recessed substantially within a peripheral profile defined by the corner guide ribs.

* * * * *